United States Patent [19]

Keeffe et al.

[11] 4,277,714

[45] Jul. 7, 1981

[54] METAL HALIDE ARC DISCHARGE LAMP HAVING COILED COIL ELECTRODES

[75] Inventors: William M. Keeffe, Rockport; Frederic Koury, Bristol; W. Calvin Gungle, Danvers, all of Mass.

[73] Assignee: GTE Products Corporation, Stamford, Conn.

[21] Appl. No.: 54,106

[22] Filed: Jul. 2, 1979

[51] Int. Cl.[3] ..... H01J 17/06; H01J 61/073

[52] U.S. Cl. ..... 313/217; 313/211; 313/344

[58] Field of Search ..... 313/211, 213, 217, 346 R, 313/344

[56] References Cited

U.S. PATENT DOCUMENTS

| | | | |
|---|---|---|---|
| 3,670,195 | 6/1972 | Kamegaya et al. | 313/213 X |
| 4,105,908 | 8/1978 | Harding et al. | 313/217 |

*Primary Examiner*—Palmer C. Demeo

*Attorney, Agent, or Firm*—James Theodosopoulos

[57] ABSTRACT

An electrode for a metal halide arc discharge lamp comprises a coiled coil on a tungsten rod, the rod diameter being equal to $W^{0.56}/0.784$ mils, where W is the input power to the lamp in watts. The primary wire for the coiled coil equals $D^{1.8}/80.8$, where D is the rod diameter in mils, and is equal to half the diameter of the mandrel wire of the coiled coil.

4 Claims, 1 Drawing Figure

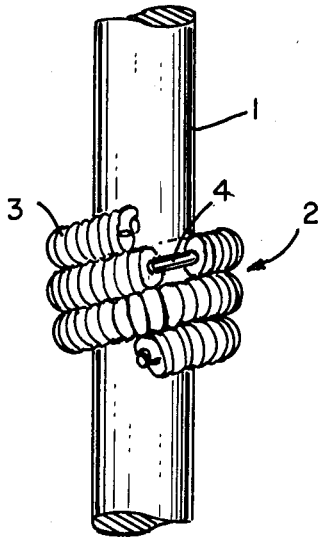
1
2
3
4

METAL HALIDE ARC DISCHARGE LAMP HAVING COILED COIL ELECTRODES

DESCRIPTION

The Invention

This invention is concerned with coiled coil electrodes for metal halide arc discharge lamps. Such electrodes are shown in U.S. Pat. No. 4,105,908 which discloses an electrode comprising a tungsten rod having a two layered coiled coil thereon. The patent discloses that the primary wire for the coiled coil should not exceed 4 mils and the mandrel wire should not exceed 5 mils, the purpose being to improve lamp maintenance. The patent states that there is maintenance improvement up to 2000 hours of life. However, since metal halide lamps have rated lives much greater than 2000 hours, maintenance results only at 2000 hours do not tell the complete story.

We have found that in order to obtain optimum maintenance throughout lamp life, an optimum coiled coil electrode should be used. The optimum coiled coil electrode only has a single layer of coiling on the tungsten rod. Also, we have found that, for optimum results, there should be a specific relationship between the rod diameter, the primary wire and the mandrel wire. The rod diameter is determined by the lamp wattage and should be about equal to the lamp wattage raised to the 0.56 power and then divided by 0.784; that is to say, $D=W^{0.56}/0.784$ where D is the rod diameter in mils and W is the lamp input power in watts. The primary wire diameter should be about equal to the rod diameter raised to the 1.8 power and then divided by 80.8, that is to say, $F=D^{1.8}/80.8$ where F is the primary wire diameter in mils. The mandrel wire diameter should be about double that of the primary wire. These equations establish optimum coiled coil electrodes for metal halide lamps having wattages up to about 400 watts. Above that size, say, at 1000 watts, the electrodes operate at such a high temperature that the primary turns of a coiled coil would melt during lamp life.

The single FIGURE shows a coiled coil electrode, partly in section, in accordance with this invention.

The coiled coil electrode is used in the usual type of high pressure metal halide arc discharge lamp such as is disclosed in U.S. Pat. No. 3,761,758 incorporated herein by reference. Such a lamp comprises an arc tube having electrodes at its ends and containing a fill including an inert gas and metal halide.

Each electrode comprises a rod 1 consisting predominantly of tungsten but which may contain some thoria. A coiled coil 2 encircles rod 1 a short distance back from the tip thereof. Coiled coil 2 comprises a primary wire 3 which is coiled onto a mandrel wire 4. Mandrel wire 4 with primary wire 3 coiled thereon is then coiled onto rod 1 to form the electrode. Or it may be coiled on a rod of similar diameter, removed therefrom and inserted onto rod 1.

In a specific embodiment, an electrode for a 400 watt metal halide lamp comprised a 36.5 mil thoriated tungsten rod 1 that was 12.7 mm long. Primary wire 3 was eight mil tungsten wire and was coiled onto sixteen mil tungsten mandrel wire 4 at 175% pitch. Mandrel wire 4, with wire 3 coiled thereon, was then coiled onto rod 1 starting 2.8 mm back from the rod tip at 100% pitch for three full turns. Lamps utilizing this new electrode were compared with lamps using the prior art 400 watt electrode which consisted of a single coil on a tungsten rod as shown in FIG. 3 of previously mentioned U.S. Pat. No. 4,105,908, in which the rod diameter was 36.5 mils and the coil was made of 28 mil wire. The lumen outputs for the new electrode lamps and prior art electrode lamps at 500 hours were 32,000 and 28,750 lumens, respectively. At 1000 hours the respective lumen outputs were 29,500 and 27,000 lumens. At 2000 hours, they were 28,500 and 26,500 and at 4000 hours they were 26,000 and 23,750. The respective maintenances at 500 hours were 94% and 83%. At 1000 hours they were 87% and 78%. At 2000 hours they were 84% and 77%, and at 4000 hours they were 76% and 69%. Thus, throughout life, the new electrode had higher lumen output and higher maintenance than the prior art electrode.

In another embodiment, 175 watt lamps were made in which the coiled coil electrode as per this invention comprised a twenty-three mil rod, three and a half mil primary wire and seven mil mandrel wire. These lamps were compared with 175 watt lamps using a two layer coiled coil electrode as per U.S. Pat. No. 4,105,908 in which the rod was twenty mils, the primary wire was two mils and the mandrel was four mils. The respective lumen outputs for the lamps were: at 100 hours, 15,950 and 15,000; at 500 hours, 15,650 and 13,050; at 1000 hours, 13,750 and 11,500; at 2000 hours, 12,150 and 9,700 lumens. The respective maintenance were: at 500 hours 98% and 87%; at 1000 hours, 86% and 77%; at 2000 hours, 76% and 65%. Thus the new electrode had higher lumen output and higher maintenance than the prior art electrode.

We claim:

1. In a metal halide arc discharge lamp having a predetermined wattage and having an arc tube containing a fill including an inert gas and metal halide and having a main electrode at each end, the electrode comprising a coiled coil mounted on a rod, the coiled coil being made of a primary wire coiled on a mandrel wire and then coiled again, the improvement comprising the diameter of the rod in mils being equal to said wattage raised to the 0.56 power and then divided by 0.784, wherein the diameter of the primary wire in mils equals the rod diameter raised to the 1.8 power and then divided by 80.8.

2. The improvement of claim 1 wherein the diameter of the mandrel wire is double that of the primary wire.

3. The lamp of claim 1 wherein said wattage equals 175 watts, the rod diameter is 23 mils, the primary wire diameter is 3½ mils and the mandrel wire diameter is 7 mils.

4. The lamp of claim 1 wherein said wattage equals 400 watts, the rod diameter is 36.5 mils, the primary wire diameter is 8 mils and the mandrel wire diameter is 16 mils.

* * * * *